US006298647B1

(12) United States Patent
Rüskens et al.

(10) Patent No.: US 6,298,647 B1
(45) Date of Patent: Oct. 9, 2001

(54) YARN-CONNECTING DEVICE FOR A CHEESE-PRODUCING TEXTILE MACHINE

(75) Inventors: Herbert Rüskens, Wegerg; Ulrich Stevens, Nettetal; Siegfried Schatton, Mönchengladbach; Gerard Küsters, Selfkant-Havert; Ottmar Neubig, Mönchengladbach; Wolf-Michael Ruh, Wegberg-Watern, all of (DE)

(73) Assignee: W. Schlafhorst AG & Co. (DE)

( * ) Notice: Subject to any disclaimer, the term of this patent is extended or adjusted under 35 U.S.C. 154(b) by 0 days.

(21) Appl. No.: 09/636,329

(22) Filed: Aug. 10, 2000

(30) Foreign Application Priority Data

Aug. 13, 1999 (DE) ..... 199 38 432

(51) Int. Cl.[7] ..... D01H 15/00
(52) U.S. Cl. ..... 57/22; 57/261
(58) Field of Search ..... 57/261, 22, 23, 57/264, 262, 263; 242/35.6

(56) References Cited

U.S. PATENT DOCUMENTS 4,232,509 * 11/1980 Rohner et al. ..... 57/22
4,408,442 10/1983 Rohmer ..... 57/22
4,844,358 * 7/1989 Kamp ..... 57/22
5,651,507 7/1997 Rüskens et al. ..... 57/22

FOREIGN PATENT DOCUMENTS 29 24 668 C2 1/1981 (DE) .
195 10 171 A1 7/1997 (DE) .

* cited by examiner

*Primary Examiner*—Danny Worrell
(74) *Attorney, Agent, or Firm*—Kennedy Covington Lobdell & Hickman, LLP

(57) ABSTRACT

A yarn-connecting device for a cheese-producing textile machine having a pneumatic splicing device (22) located outside of the normal travel path of the yarn, a gripper tube (25) acted upon by suction air for manipulating yarn ends to be spliced, and a pivotable gripper tube flap (18) for closing the gripper tube mouth (27). A control crank (33) is arranged at an upper end position (II) of the gripper tube (25) for acting on the gripper tube flap (18) such that in the course of pivoting the gripper tube (25) into the position (II), the gripper tube flap (18) is lifted slightly off the gripper tube mouth (27), while the gripper tube flap (18) always closes the gripper tube mouth (27) when the gripper tube (25) is pivoted out of the position (II).

5 Claims, 5 Drawing Sheets

YARN-CONNECTING DEVICE FOR A CHEESE-PRODUCING TEXTILE MACHINE

CROSS REFERENCE TO RELATED APPLICATIONS

This application claims the benefit of German Application DE P19938432.0 filed Aug. 13, 1999, herein incorporated by reference.

FIELD OF THE INVENTION

The present invention relates to a yarn-connecting device for a cheese-producing textile machine having a splicing device located outside of the normal path of yarn travel and operable for the pneumatic connection of yarn ends, a gripper tube through which is applied for manipulating the yarn ends to be spliced, and a pivotably seated gripper tube flap for closing the mouth of the gripper tube.

BACKGROUND OF THE INVENTION

Yarn-connecting devices of the afore-described type are known, for example, from German Patent Publication DE 195 10 171 A1.

With these devices, an automatic yarn-connecting and/or cop-changing device is activated via the winding station computer of the respective winding station of the cheese-producing machine in case of a yarn break or a change of the delivery bobbin. More specifically, a suction nozzle is first placed against the surface of the take-up bobbin which is caused to slowly rotate in a direction opposite the winding direction. After the suction nozzle has grasped the yarn end trailing from the take-up bobbin (often referred to as the "upper yam end"), the suction nozzle is pivoted back into its initial position, in which the aspirating nozzle opening is positioned below a splicing device.

A gripper tube positioned in a lower initial position is pivoted almost simultaneously with the suction nozzle into an upper work position and in the process carries along a leading yarn end drawn off the delivery bobbin (often referred to as the "lower yarn end") which had been held in a fixed position up to that time, for example, in a yarn tenser.

On its end, the gripper tube has a pivotably seated gripper tube flap, which is biased into a closed position for example by a spring force, and has a yarn placement hook. In the course of upward pivoting, the gripper tube intersects the path of the trailing upper yarn end from the take-up bobbin with the yarn placement hook in order to also engage and carry this yarn, and the gripper tube then positions both yarn ends in the splicing device in a functionally correct manner to be pneumatically spliced together. More specifically, the gripper tube flap, which mechanically fixes the bottom yarn in place via its gripper tube flap and takes along the top yarn via its yarn placement hook during the upward pivoting of the gripper tube, is slightly opened by means of an appropriately curved element when the gripper tube enters its terminal position, so that the two ends of yarn are placed into the splicer in a tensioned manner.

Following the cutting of excess portions of the two yarn ends by appropriate cutter devices of the splicer, the cut excess portion of the bottom yarn is aspirated off by the gripper tube. Thereafter, the gripper tube is pivoted back into its initial position. In the course of downward pivoting of the gripper tube, the gripper tube flap, which is still guided on the curved element, initially remains in a position in which the mouth of the gripper tube is at least partially open. Only after the gripper tube has disengaged from the curved element does the gripper tube flap close the mouth of the gripper tube either under the influence of the prevailing suction acting through the gripper tube or of via the aforementioned spring biasing element.

A disadvantage of this embodiment of the gripper tube is the danger that, in case of a yarn break or an intentional yarn cut by a cleaning device at the winding station which occurs while the gripper tube flap is still held open by the curved element, the gripper tube could aspirate the yarn during the downward movement. If the yarn is then again aspirated underneath the yarn tenser during the ensuing yarn break or cleaning operation which will be immediately initiated, winding of the yarn around the flap of the gripper tube can occur, which results in considerable trouble at the yarn-connecting device.

OBJECT AND SUMMARY OF THE INVENTION

In view of the foregoing, an object of the present invention is to improve the known yarn-connecting devices of the type described above and, more particularly, to provide an improved gripper tube arrangement.

In accordance with the present invention, this object is attained by a yarn-connecting device wherein the gripper tube flap of the gripper tube is controlled by a control device which acts upon the gripper tube flap differently when it is being pivoted upwardly or pivoted downwardly into and out of the position in which it inserts the yarn ends to be spliced into the splicing device. More specifically, this arrangement of the present invention advantageously provides that, when pivoting the gripper tube upwardly into the splicer in the initial operational phase of inserting the yarn ends into the splicer, it is possible to control the gripper tube flap such that the flap is lifted off the gripper tube mouth. In the process, the ends of yarn are well tensioned. After the ends of yarn have been inserted into the splicer, the gripper tube flap is closed and the gripper tube flap remains closed during the downward pivoting of the gripper tube back to its starting position, so that the yarn ends cannot be aspirated by the gripper tube in case of another yarn break or cleaning cut.

An advantageous embodiment of the present invention provides for the closing movement of the gripper tube flap to be achieved not only by means of the prevailing suction within the gripper tube, but also by contact of a control element of the gripper tube flap, preferably in the form of a cam follower, against a sliding cam track of a spring-biased guide element of the control device.

Preferably, the guide element has two separate sliding cam tracks, which work together to act sequentially upon the control cam follower of the gripper tube flap. More specifically, a first upper sliding cam track, in accordance with the representation in FIGS. 3*a* to 3*c*, assures that the gripper tube flap is lifted off the gripper tube mouth by engagement with the control cam follower of the gripper tube flap when the gripper tube is pivoted into the vicinity of the control device, while the second, lower sliding cam track assures that the gripper tube flap is always closed when the gripper tube is pivoted out of the vicinity of the control device.

In a preferred embodiment, the control device basically comprises a base body stationarily fixed in place on the winding station housing by means of a holder, and a curved guide element seated for limited movability on the base body and acted upon by the force of a biasing spring. The curved element is urged into a preselected base position by the spring element.

The curved element has a strip which extends into the pivot path of the gripper tube and comprises the two sliding cam tracks. The curved element is seated in such a way that the control cam follower of the gripper tube flap is deflected outward in the course of upward pivoting of the gripper tube, and as a result, the gripper tube flap is slightly lift ed off the gripper tube mouth. In the course of pivoting the gripper tube downwardly, the control cam follower of the gripper tube flap is guided along the second sliding track and the curved element of the control device evades the control cam follower of the gripper tube flap. As a result, the gripper tube flap is acted upon, in addition to the prevailing underpressure within the gripper tube, by the curved element and, in turn, by the spring biasing force acting on the curved element. In this manner, the gripper tube flap is always dependably maintained in the closed position except when entering the position in which the gripper tube delivers yarn ends for spicing into the splicing device.

The gripper tube also preferably has a notch in the area of the gripper tube mouth, by means of which the excess portion of the lower yarn end is removed after being cut by the splicing cutters. Thus, the removal of excess lengths of yarn is facilitated by this notch in the area of the gripper tube mouth even when the gripper tube flap rests completely on the gripper tube mouth.

Further details, features and advantages of the present invention will be described and understood from the following disclosure of an exemplary embodiment with reference to the accompanying drawings.

DETAILED DESCRIPTION OF THE PREFERRED EMBODIMENT

Figure 1:
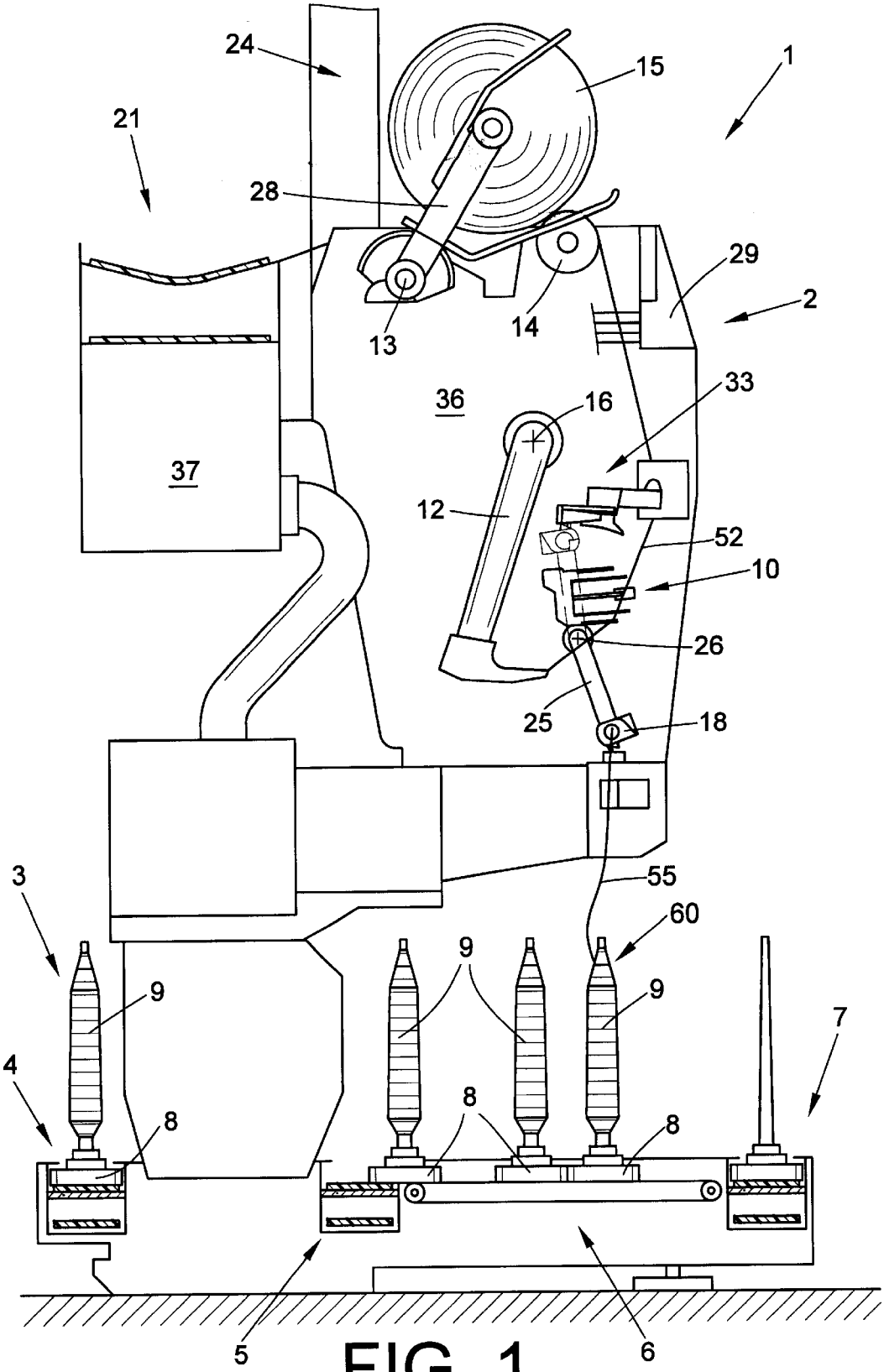
FIG. 1 is a cross-sectional view taken through a winding station of a cheese-producing textile machine, in the present case an automatic cheese winder, wherein a preferred form of a yarn-connecting device of the present invention is embodied.
Figure 2:
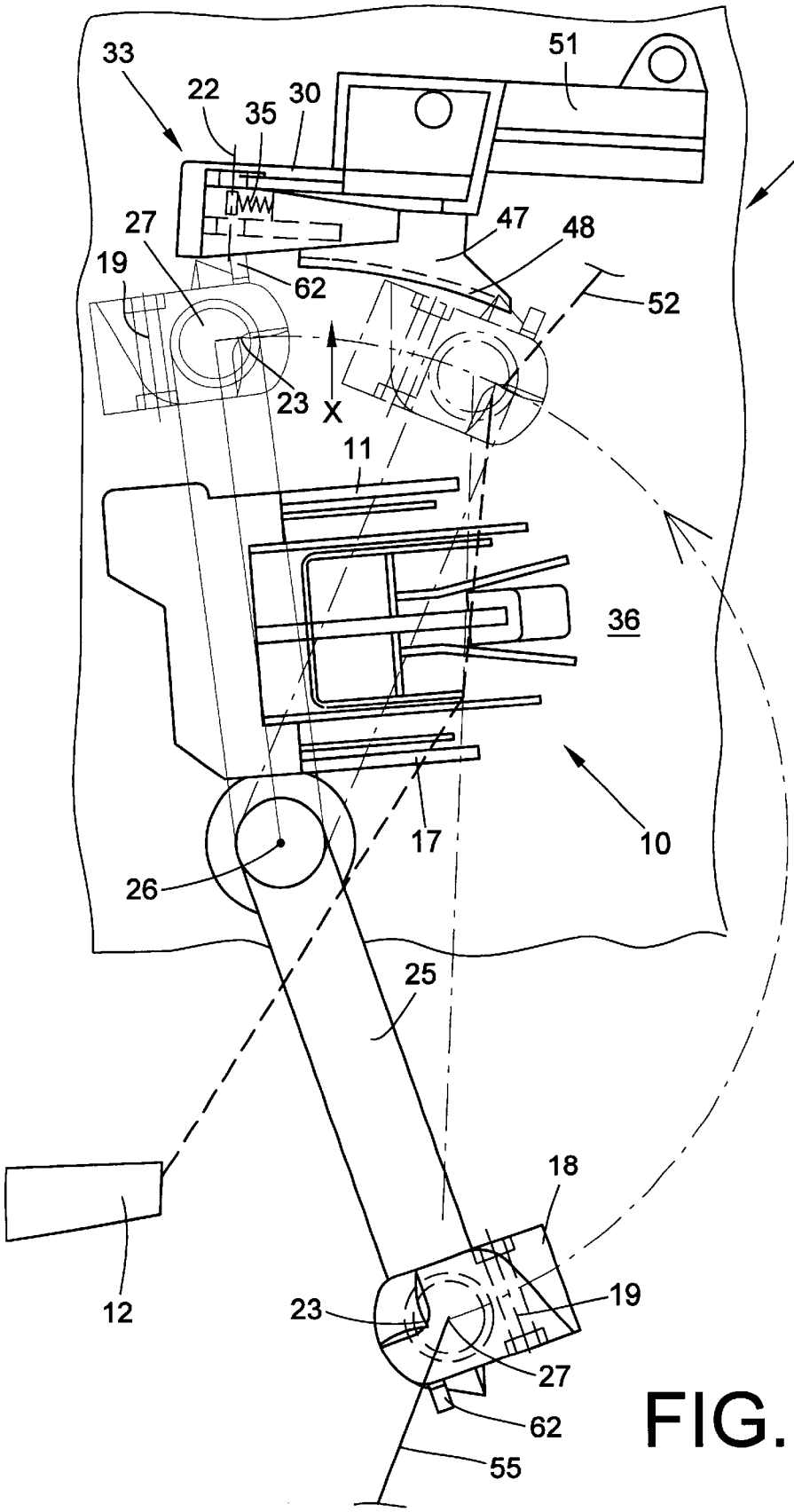
FIG. 2 is a more detailed view of the yarn-connecting device which includes a pneumatic splicing device and a gripper tube movable into various positions.

Referring now to the accompanying drawings and initially to FIG. 1, a cheese-producing textile machine, identified as a whole by the reference numeral 1, is schematically depicted in a front view in the form of an automatic cheese winder in the present embodiment. Customarily, such automatic cheese winders have a plurality of work stations, in the present case winding stations 2, all of the same type aligned with one another along the length of machine between its end frames (not represented).

In a known manner, and therefore not explained in greater detail, spinning cops 9 previously produced on a ring spinning machine are rewound into cheeses 15 of large volume in these spinning stations 2.

Following their completion, the cheeses 15 are transferred by means of an automatically operating service unit, preferably a cheese changer (not represented), to a cheese transport device 21 extending over the length of the machine, by which the cheeses are transported to a bobbin loading station or the like, arranged at the end of the machine.

In addition, such automatic cheese winders 1 also have a logistic arrangement in the form of a bobbin and tube transport conveyor system 3. Spinning cops 9 to be rewound into cheeses and empty unwound cop tubes circulate in this bobbin and tube transport system 3 on transport plates 8.

Moreover, such an automatic cheese winder 1 customarily has a central control unit, which is connected via a machine bus with separate work station computers 29 arranged at each of the individual winding stations 2, and is also connected with a control device of the service unit.

For sake of simplicity, only the cop delivery track 4, the reversibly operable storage track 5, one of the transverse transport tracks 6 leading to each of the winding stations, and the tube return track 7, of the above mentioned tube transport system 3, are represented in FIG. 1.

The delivered spinning cops 9 are rewound into cheeses 15 of large volume in the unwinding position 60, which is located in the area of the transverse transport tracks 6 at the winding stations 2. As is known, and therefore only schematically indicated, the individual winding stations have various sub-assemblies, mechanisms and other devices which assure the correct operation of these work stations, including, for example, a suction nozzle 12, a gripper tube 25, and a yarn-connecting device 10 which in the present case is preferably in the form of a pneumatic splicer.

The pneumatic splicer is positioned to be set slightly back in respect to the regular path of yarn travel normally prevailing during a rewinding operation. The splicer includes an upper clamping and cutting device 11 and a lower clamping and cutting device 17.

Such winding stations 2 furthermore have additional installations, not represented in detail, such as a yarn tenser, a yarn cleaner/cutter, a waxing installation, a yarn tensile force sensor, as well as a bottom yarn sensor.

A winding device, identified as a whole by the reference numeral 24, is comprised of a creel 28, which is seated to be movable around a pivot shaft 13, and a device for the rotatable holding of a tube for the winding thereabout of a cheese. During the winding process, the cheese 15 rests with its surface on a grooved drum 14 by which the cheese is driven via frictional surface contact.

As already indicated above, each winding station 2 has a suction nozzle 12, as well as a gripper tube 25, each of which is connected via a suction air connection to a suction conduit 37 extending over the length of the machine. Here, the suction nozzle 12 is seated to be pivotable to a limited extent around an axis of rotation 16, while the gripper tube 25 is seated around an axis of rotation 26.

Furthermore, the gripper tube 25 has a gripper tube flap 18, which makes it possible to close the gripper tube mouth 27. The gripper tube flap 18 will be explained in greater detail below, in particular by means of FIGS. 2 and 3*a*–3*c*.

As can be particularly seen in FIGS. 2 and 3*a*–3*c*, the gripper tube flap 18 is seated so that it is rotatable around a pivot axis 19 to a limited degree. A spring element 53 is disposed between the gripper tube 25 and the gripper tube flap 18 in the area of the pivot axis 19 and acts to bias the gripper tube flap 18 into a position closing the gripper tube mouth 27.

Figure 3A:
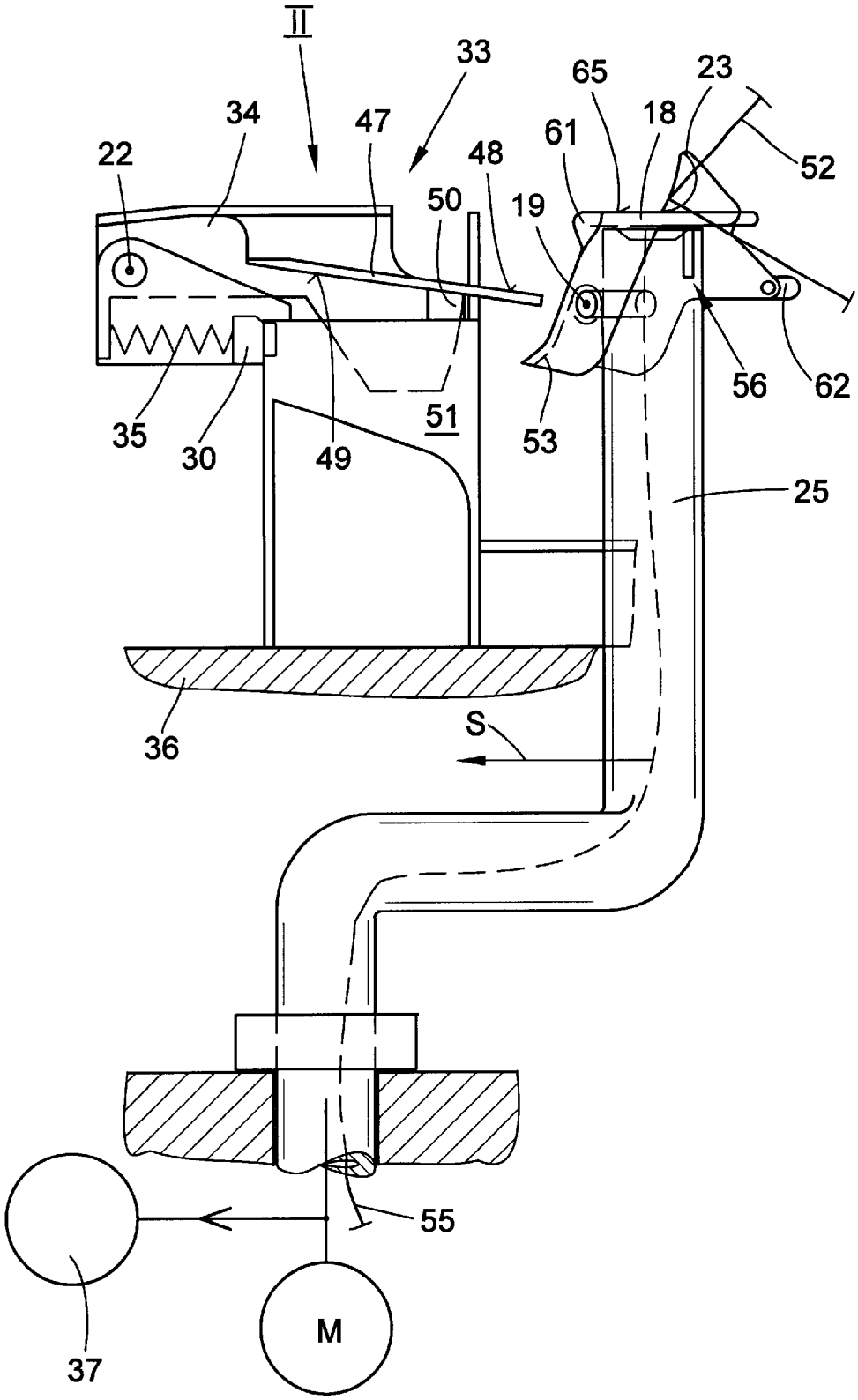
FIGS. 3*a* to 3*c* show the control crank in accordance with the present invention for acting upon the control cam of the gripper tube flap of the gripper tube.
Figure 3B:
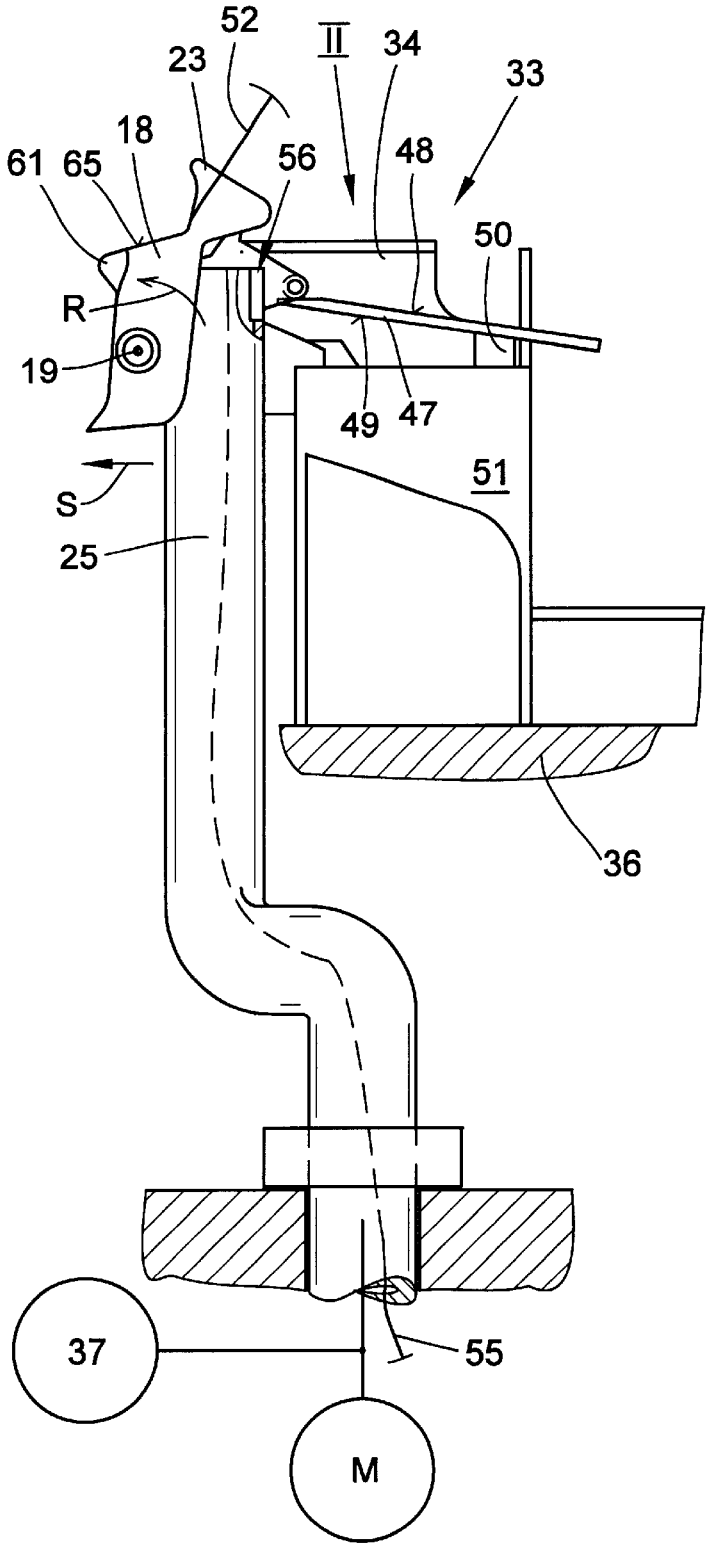
Figure 3C:
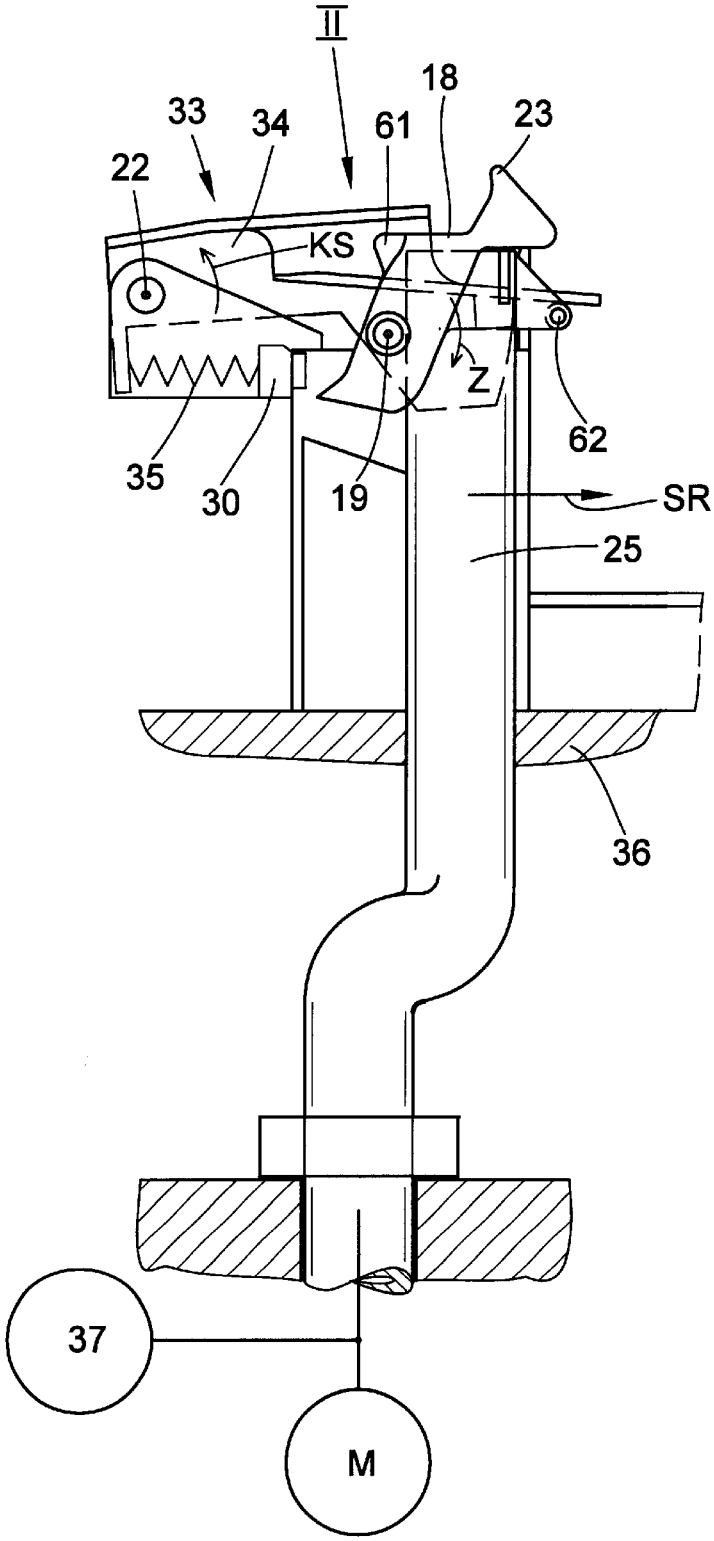

As shown in FIGS. 3*a* to 3*c* in particular, the gripper tube flap 18 has a forward projecting yarn placement hook 23 on its front plate 65, as well as a yarn guidance device between the yarn placement hook 23 and the pivot axis 19. In the embodiment illustrated, the yarn guidance device is preferably in the form of a nose-like protrusion 61, projecting in the pivot direction S of the gripper tube.

Furthermore, the gripper tube flap 18 has a control cam follower 62 which operates in association with a control device in the form of a control crank 33 stationarily arranged in the area of the upper end position II of the gripper tube 25 to achieve a defined opening and closing of the gripper tube flap 18.

As represented in FIGS. 3*a* to 3*c*, the control crank 33 comprises a base body 30 fixed in place, for example on the winding station housing 36, by means of a holder 51, and a curved cam element 34 connected with the base body 30 and pivotable to a limited degree around a pivot shaft 22. In this case, a spring element 35, preferably a compression spring, is inserted between the base body 30 and the curved cam element 34. The spring element assures that, in the resting state of the curved cam element in which it is not acted upon the gripper tube flap, the curved cam element 34 is always urged into a base position represented in FIG. 3*a* in which the curved cam element 34 is supported on the holder 51 by means of a detent 50.

The curved cam element 34 has a central strip 47, whose two lateral surfaces respectively constitute a sliding cam track 48 and a sliding cam track 49. In the course of the entry of the gripper tube 25, the respective sliding cam tracks 48 or 49 work together with the control cam follower 62 of the gripper tube flap 18. The operation of the device may thus be understood. In case of a yarn break, or during a cut by the cleaning device, a lower end of yarn 55 leading from the delivery cop being unwound is as a rule maintained in a yarn tenser, not shown in detail, while an upper end of yarn 52 trails from the cheese typically having been wound onto the surface of the cheese 15.

Thus, the suction nozzle 12 is initially pivoted upwardly into the vicinity of the cheese 15, which at the same time is caused to slowly rotate counter to its normal winding direction, and the upper yarn end 52 is located and aspirated by the suction nozzle 12. Thereafter, the suction nozzle 12 is pivoted into its lower operating position (see FIG. 2), and in the process places the upper yarn end 52 into a cleaning device, a cutting device, as well as an opened clamping and cutting device 17, arranged below the splicing device 10.

The lower yarn end 55 is picked up thereafter by means of the gripper tube 25. For this purpose, the gripper tube mouth 27 of the gripper tube 25 is pivoted into an area slightly below the yarn tenser, and thereat pneumatically grasps the lower yarn end 55. The control cam follower 62 arranged on the gripper tube flap 18 slides in the process over a lower control crank (not represented), which acts upon the gripper tube flap 18 against the biasing force of the spring element 53 to pivot the gripper tube flap 18 into an open position to facilitate the pneumatic grasping of the lower yarn end 55.

In the course of the upward pivoting movement gripper tube 25, the gripper tube flap 18 closes again and thereby fixes the bottom yarn 55 mechanically in place. As the gripper tube continues its pivoting movement into its upper end position II, the yarn placement hook 23 arranged on the gripper tube flap 18 intersects the path of the upper yarn end 52 and thereby carries it along.

As indicated in FIGS. 3*a* to 3*c*, the control cam follower 62 of the gripper tube flap 18 enters the control crank 33 and, in the course of doing so, acts together with the sliding cam track 48 of the curved cam element 34. Because the curved cam element 34 is supported by means of a detent 50 on the holder 51, the control cam follower 62 of the gripper tube flap 18 is pushed outwardly, and in the process, pivots the gripper tube flap 18 in the direction of the arrow R. This pivoting of the gripper tube flap 18 not only leads to the gripper tube mouth 27 being slightly opened and the lower yarn end 55 being tensed by the action of the prevailing underpressure, but also leads to tensing of the upper yarn end 52 carried around the yarn placement hook 23. In this case, pivoting of the gripper tube flap 18 takes place against the pressure of the underpressure prevailing in the gripper tube 25, as well as against the spring force of a spring element 53, if such is provided.

As soon as the control cam follower 62 of the gripper tube flap 18 has passed over the sliding cam track 48, the control cam follower 62 is pivoted inward, whereby in the end position II of the gripper tube 25, the gripper tube mouth 27 is already assuredly closed by means of the gripper tube flap 18.

In the course of the subsequent downward pivoting of the gripper tube 25, the control cam follower 62 slides along the second sliding cam track 49 and in the process pivots the curved cam element 34 of the control crank 33 in the direction KS, as indicated in FIG. 3c. In the process, the spring element 35 interposed between the base body 30 and the curved cam element 34 of the control crank 33 additionally acts on the control cam follower 62 of the gripper tube flap 18 with a spring force and assures that, as the gripper tube 25 is pivoting downwardly, the gripper tube flap 18 of the gripper tube 25 is already assuredly closed along this area of the pivot path of the gripper tube 25.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. In a cheese-producing textile machine, a yarn-connecting device comprising a yarn-end splicing device located outside a normal travel path of the yarn, a gripper tube for manipulating yarn ends to be spliced, the gripper tube being acted upon by suction air and being movable between a first position for retrieving the yarn ends to be spliced and a second position for placing the yarn ends into the splicing device, a pivotably seated gripper tube flap for closing a mouth of the gripper tube, and a control device arranged at the second position of the gripper tube for acting on the gripper tube flap to open the gripper tube flap in the course of movement of the gripper tube from the first position toward the second position and to close the gripper tube flap in the course of movement of the gripper tube from the second position toward the first position.

2. The yarn-connecting device in accordance with claim 1, characterized in that the control device comprises a first sliding track for actuating opening movement of the gripper tube flap when the gripper tube is moving into the second position and a second sliding track for actuating closing movement of the gripper tube flap when the gripper tube is moving out of the second position.

3. The yarn-connecting device in accordance with claim 2, characterized in that the control device comprises a base body, a curved element seated on the base body for movement with respect thereto, and a spring element disposed between the base body and the curved element for urging the curved element into a base position.

4. The yarn-connecting device in accordance with claim 3, characterized in that the gripper tube flap includes a control cam follower operable in association with the sliding tracks, and the curved element comprises a strip on which the sliding tracks are arranged.

5. The yarn-connecting device in accordance with claim 1, characterized in that the gripper tube includes a notch is arranged in the area of the gripper tube mouth which notch remains open throughout the operation of the connecting device.

* * * * *